US007760174B2

(12) United States Patent
Ku

(10) Patent No.: US 7,760,174 B2
(45) Date of Patent: Jul. 20, 2010

(54) APPARATUS AND METHOD FOR DRIVING SMALL-SIZED LCD DEVICE

(75) Inventor: Yong-Geun Ku, Hwaseong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1056 days.

(21) Appl. No.: 11/331,792

(22) Filed: Jan. 14, 2006

(65) Prior Publication Data

US 2006/0158416 A1 Jul. 20, 2006

(30) Foreign Application Priority Data

Jan. 15, 2005 (KR) ..... 10-2005-0003983

(51) Int. Cl.
*G09G 3/36* (2006.01)

(52) U.S. Cl. ..... 345/87; 345/89; 345/92; 345/98; 345/101

(58) Field of Classification Search ..... 345/58, 345/75.2, 87, 89, 92, 98, 101, 107, 204, 605, 345/690; 358/445, 494, 500, 515, 519, 531, 358/538; 382/254, 162, 167; 348/294, 230.1, 348/237, 364; 359/267
See application file for complete search history.

(56) References Cited

U.S. PATENT DOCUMENTS 5,130,794 A * 7/1992 Ritchey ..... 348/39
5,296,946 A * 3/1994 Kadowaki et al. ..... 358/531
5,748,335 A * 5/1998 Honma et al. ..... 358/445
5,798,740 A * 8/1998 Bitzakidis et al. ..... 345/92
5,798,753 A * 8/1998 Zhou et al. ..... 345/603
6,445,367 B1 * 9/2002 Suzuki et al. ..... 345/75.2
6,501,446 B1 * 12/2002 De Haan et al. ..... 345/63
6,778,290 B2 * 8/2004 Oehlbeck et al. ..... 358/1.15
7,525,528 B2 * 4/2009 Feng ..... 345/87
7,599,552 B2 * 10/2009 Yamazoe ..... 382/167
2003/0038764 A1 * 2/2003 Oehlbeck et al. ..... 345/87
2004/0126010 A1 * 7/2004 Yamazoe ..... 382/162
2004/0252111 A1 * 12/2004 Cheon et al. ..... 345/204
2005/0276502 A1 * 12/2005 Brown et al. ..... 382/254
2007/0206262 A1 * 9/2007 Zhou ..... 359/267

FOREIGN PATENT DOCUMENTS

JP 2003-084736 3/2003
KR 1020030020692 A 3/2003
KR 1020030087275 A 11/2003

* cited by examiner

*Primary Examiner*—Prabodh M Dharia
(74) *Attorney, Agent, or Firm*—F.Chau & Associates, LLC

(57) ABSTRACT

An apparatus and method for driving a small-sized or low-powered liquid crystal display (LCD) device are provided to reduce the amount of energy consumed in driving the LCD device while displaying a high-quality moving image on a small-sized LCD panel without distortion such as tailing or blurriness, where the apparatus includes a compensation unit, a storage unit, an output unit, and a control unit.

23 Claims, 5 Drawing Sheets

APPARATUS AND METHOD FOR DRIVING SMALL-SIZED LCD DEVICE

CROSS-REFERENCE TO RELATED APPLICATION

This application claims foreign priority under 35 U.S.C. §119 to Korean Patent Application No. 10-2005-0003983, filed on Jan. 15, 2005, in the Korean Intellectual Property Office, the disclosure of which is incorporated herein in its entirety by reference.

BACKGROUND OF THE INVENTION

1. Field of the Invention

The present disclosure relates to liquid crystal display (LCD) devices, and more particularly relates to an apparatus and method for driving a LCD device.

2. Description of the Related Art

Liquid crystal display (LCD) devices are devices for displaying an image by appropriately adjusting the transmissivity of liquid crystal cells depending on the type of an image signal. The transmissivity of a liquid crystal material may change according to the arrangement of liquid crystal molecules generated when an electric field is applied to the liquid crystal material.

Specifically, the arrangement of liquid crystal molecules varies over a long period of time. Due to such time delay, a moving image may suffer from tailing, blurriness, or a low dynamic contrast ratio or may look as if it was seen through a stroboscope when displayed by an LCD device.

In order to solve this problem, a response time compensation (RTC) method has been suggested. The RTC method is an LCD driving method that improves and compensates for the response speed of a liquid crystal material using an overshoot so that the liquid crystal material can quickly respond to a driving signal within 1 frame.

FIG. 1 is a graph comparing the LCD driving signals before and after compensation of the response speed of an LCD device using the RTC method. Referring to FIG. 1, Gn is an LCD driving signal yet to be compensated for, and Gn' is an LCD driving signal compensated for using an overshoot.

In a case where the response speed of an LCD device has not been compensated for, the output level of a liquid crystal material changes in response to the LCD driving signal Gn. In this case, the liquid crystal material cannot reach a desired output level within one frame.

On the other hand, in a case where the response speed of the LCD device has been compensated for using an overshoot, the output level of the liquid crystal material changes in response to the compensated LCD driving signal Gn'. In this case, the liquid crystal material can reach a desired output level within one frame.

The above-mentioned LCD driving method that compensates for the response speed of an LCD device using an overshoot is called an LCD overdriving method. In a conventional LCD overdriving method, an LCD device is driven by comparing gray values of pixels of a current frame of a moving image with gray values of pixels of a previous frame of the moving image and then adding/subtracting an overshoot value to/from the gray values of the pixels of the current frame based on the comparison results.

The overshoot value is determined in consideration of the characteristics of a panel of the LCD device and is stored in a lookup table (LUT). The LUT is comprised of a plurality of overshoot values determined based on a result of comparing gray values of pixels of a current frame with gray values of pixels of a previous frame.

FIG. 2 is a block diagram of a conventional apparatus 200 for driving an LCD device. Referring to FIG. 2, the conventional apparatus 200 includes a storage unit 210, a LUT unit 230, and a calculation unit 250. The storage unit 210 stores pixel data of consecutive frames of moving image data (i.e., RGB data) output from a central processing unit or a baseband processing unit.

The LUT unit 230 includes a LUT, which is comprised of a plurality of overshoot values determined according to the characteristics of a panel of an LCD device. Pixel data Gn of a current frame of input moving image data and pixel data Gn−1 of a previous frame of the input moving image data, which is stored in the storage unit 210, are input to the LUT unit 230.

The LUT unit 230 reads and outputs one of the overshoot values of the LUT based on the pixel data Gn and the pixel data Gn−1. The calculation unit 250 compensates for the pixel data Gn by adding/subtracting the overshoot value output from the LUT unit 230 to/from the pixel data Gn and outputs the compensated pixel data Gn to a source driving unit (not shown).

As described above, a conventional LCD driving apparatus using the RTC method can compensate for the response speed of an LCD device, such as an LCD TV or a video game device, within one frame and thus can improve the quality of a moving image displayed by the LCD device. Unfortunately, the conventional LCD driving apparatus using the RTC method is only applicable to large-sized or line-powered LCD devices such as an LCD TV or a video game device, and cannot be practically applied to a small-sized or battery-powered LCD device, which includes a small-sized driving chip, and that is more sensitive to variations in the price of driving chips and consumption current.

SUMMARY OF THE INVENTION

The present disclosure provides an apparatus for driving a small-sized LCD device that determines how the LCD device is to be driven based on the type of image displayed by the LCD device and that compensates for the response speed of the LCD device with reference to a lookup table.

The present disclosure also provides a method of driving a small-sized LCD device that determines how an LCD device is to be driven based on the type of image displayed by the LCD device and that compensates for the response speed of the LCD device with reference to a lookup table.

According to an aspect of the present disclosure, there is provided an apparatus for driving a liquid crystal display (LCD) panel of an LCD device, the apparatus comprising: a compensation unit, which compensates for first image data with reference to a predetermined lookup table (LUT) in response to a first input control signal in a first mode, the first image data being consecutively input to the apparatus; a storage unit, which updates and then stores the first image data and second image data and outputs one of the first image data or the second image data in response to a second input control signal, the second image data being consecutively input to the apparatus; an output unit, which outputs one of the first image data, the second image data, or the compensated first image data in response to an output control signal; and a control unit, which generates the first input control signal, the second input control signal, and the output control signal in response to a predetermined control signal.

According to another aspect of the present disclosure, there is provided a method of driving a liquid crystal display (LCD) panel of a LCD device, the method comprising: storing first image data and second image data, which are consecutively input; compensating for the first image data with reference to a predetermined lookup table (LUT) based on a result of comparing the current frame of the first image data with a previous frame of the first image data and delaying and then outputting the compensated first image data in a first mode; outputting the stored first image data in a second mode; outputting the stored second image data in a third mode; and delaying and then outputting the first image data in a fourth mode.

BRIEF DESCRIPTION OF THE DRAWINGS

The above and other features and advantages of the present disclosure will become more apparent by describing in detail exemplary embodiments thereof with reference to the attached drawings, in which.

DETAILED DESCRIPTION OF PREFERRED EMBODIMENTS

Figure 1:
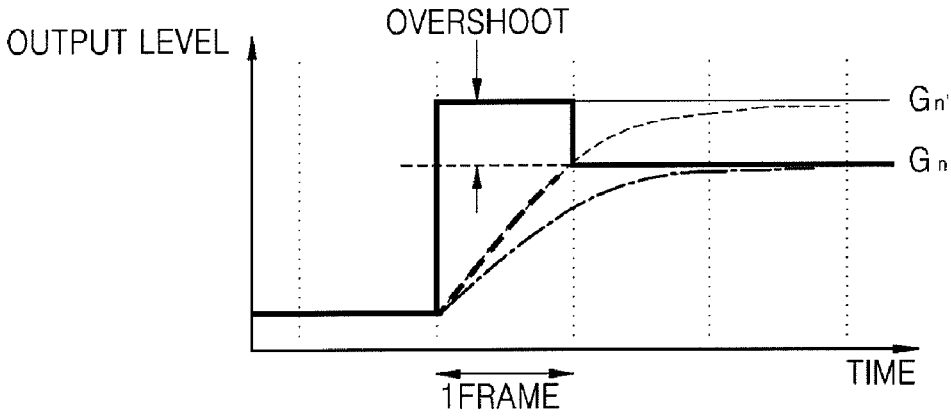
FIG. 1 (Prior Art)
FIG. 1 is a graph comparing the LCD driving signals before and after compensation of the response speed of an LCD device using the RTC method.
Figure 2:
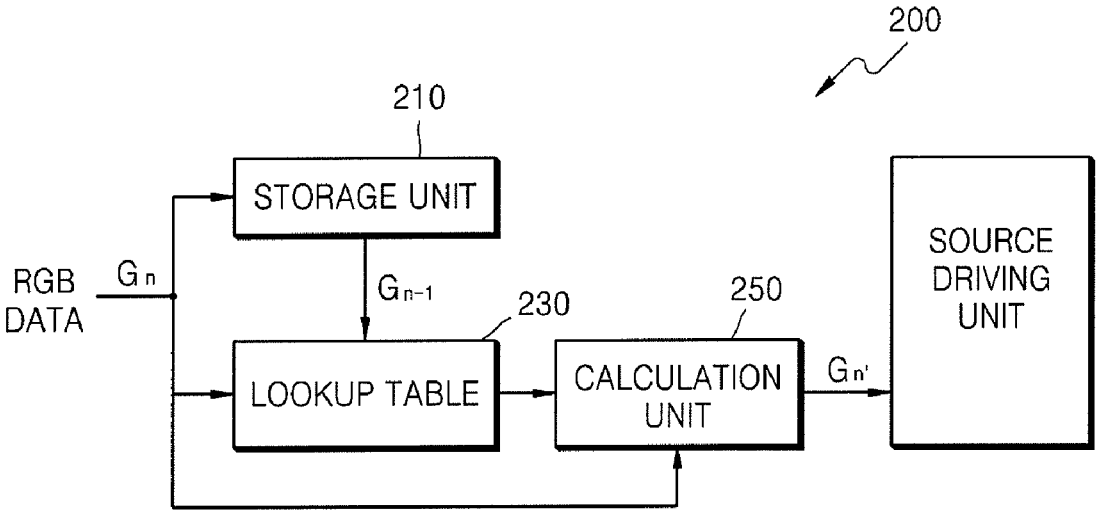
FIG. 2 (Prior Art)
FIG. 2 is a block diagram of a conventional LCD driving apparatus.

Embodiments of the present disclosure determine how a liquid crystal display (LCD) device is to be driven based on the type of image displayed by the LCD device, and compensate for the response speed of the LCD device with reference to a predetermined lookup table when the LCD device displays a moving image. Exemplary embodiments will now be described more fully with reference to the accompanying drawings in which exemplary embodiments of the disclosure are shown. In the drawings, like reference numerals may represent like elements.

Figure 3:
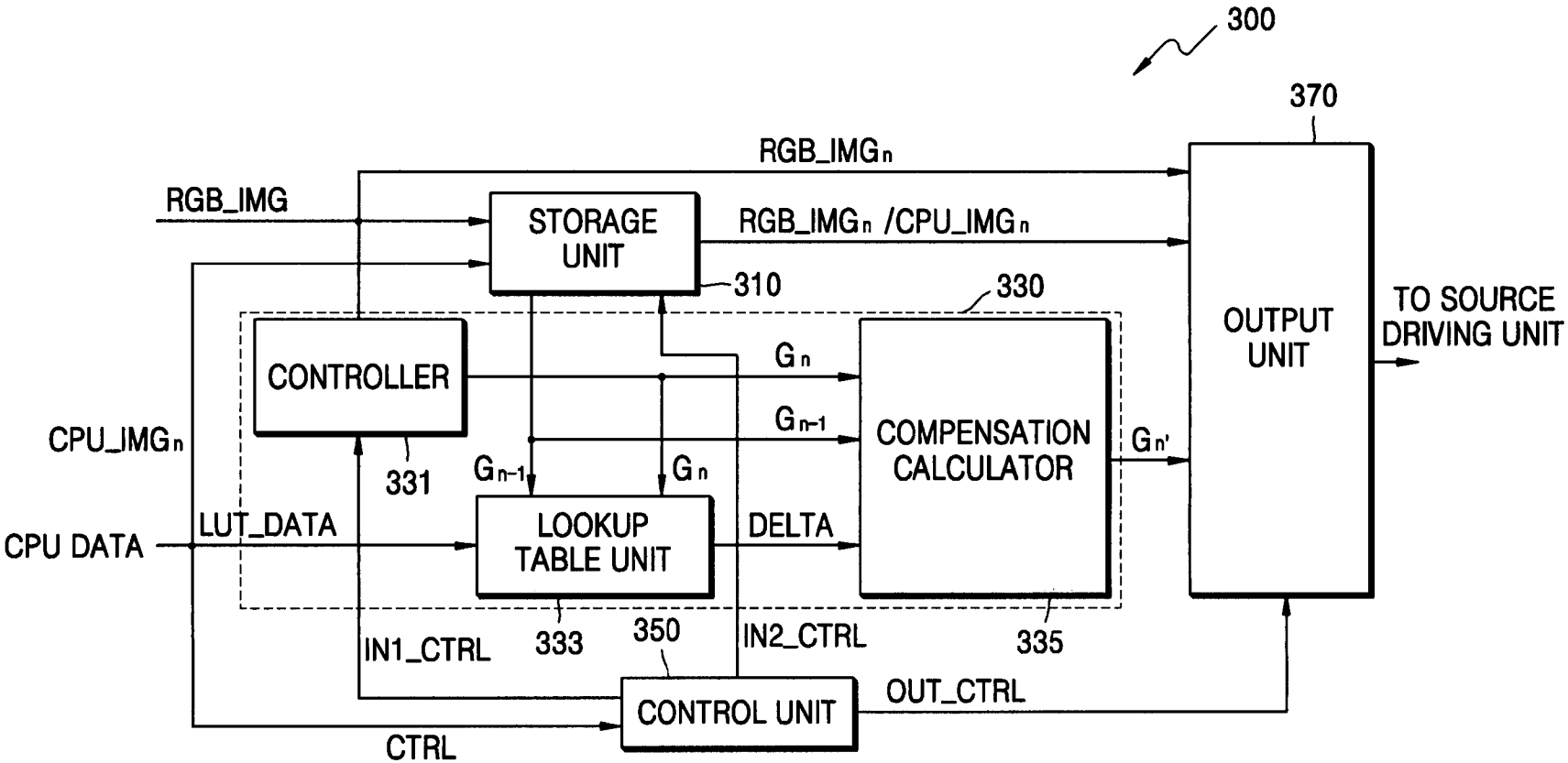
FIG. 3 is a block diagram of an LCD driving apparatus according to an exemplary embodiment of the present disclosure.

FIG. 3 is a block diagram of an LCD driving apparatus 300 according to an exemplary embodiment of the present disclosure. Referring to FIG. 3, the LCD driving apparatus 300 receives first image data RGB_IMG and central processing unit (CPU) data from a CPU or a baseband processing unit of an LCD device, and operates in response to the first image data RGB_IMG and the CPU data.

The first image data RGB_IMG is used for displaying a moving image, and the CPU data is used for controlling the operation of the LCD driving apparatus 300. The first image data RGB_IMG may be regular moving image data or high-quality moving image data, for example.

The CPU data includes a control signal CTRL, which is used for controlling the operation of the LCD driving apparatus 300. In a case where the LCD device displays a still image, the CPU data may also include second image data CPU_IMG, which is still image data. In addition, in the case of updating a lookup table (LUT), the CPU data may also include LUT data LUT_DATA.

The LCD driving apparatus 300 may operate in four different modes, i.e., first through fourth modes, depending on the type of image displayed by the LCD device. The first mode is a moving image compensation mode for driving the LCD device to display a high-quality moving image. In the first mode, moving image data is appropriately compensated for with reference to an LUT. The second mode is a regular moving image mode for driving the LCD device to display a moving image whose data is relatively slowly updated compared to other regular moving image data.

The third mode is a still image mode for driving the LCD device to display a still image. The fourth mode is a bypass mode for driving the LCD device to display a moving image whose data is relatively quickly updated compared to other regular moving image data.

The operation of the LCD driving apparatus 300 will now be described more fully with reference to FIGS. 3 through 6. The LCD driving apparatus 300 includes a storage unit 310, a compensation unit 330, a control unit 350, and an output unit 370.

The compensation unit 330 compensates for the first image data RGB_IMG, which is comprised of a plurality of frames sequentially input to the LCD driving apparatus 300 in response to a first input control signal IN1_CTRL, with reference to a predetermined LUT in the first mode. The operation of the compensation unit 330 will be described in detail further below with reference to FIG. 5.

The storage unit 310 updates the first image data RGB_IMG and the second image data CPU_IMG, and then stores the updated first image data RGB_IMG and the updated second image data CPU_IMG therein. The first image data RGB_IMG, which is moving image data, is stored in the storage unit 310 in units of frames.

The storage unit 310 outputs image data stored therein in response to a second input control signal IN2_CTRL. Specifically, in the first mode, the storage unit 310 outputs a frame $RGB_IMG_{n-1}$ (hereinafter referred to as a non-compensated previous frame) of the first image data RGB_IMG, which has been input to and then stored in the storage unit 310 ahead of a frame $RGB_IMG_n$ (hereinafter referred to as a non-compensated current frame) of the first image data RGB_IMG currently being input to the storage unit 310, to the compensation unit 330 in response to the second input control signal IN2_CTRL.

In the second mode, the storage unit 310 outputs the non-compensated current frame $RGB_IMG_n$ stored therein to the output unit 370 in response to the second input control signal IN2_CTRL. In the third mode, the storage unit 310 outputs the second image data $CPU_IMG_n$ currently stored therein to the output unit 370.

The control unit 350 generates the first input control signal IN1_CTRL, the second input control signal IN2_CTRL, and an output control signal OUT_CTRL in response to a control signal CTRL, which is determined depending on whether a current mode is the first, second, third, or fourth mode.

The output unit 370 outputs the non-compensated current frame RGB_IMGn of the first image data RGB_IMG, the current frame CPU_IMGn of the second image data CPU_IMG, or a compensated current frame Gn', which is obtained by compensating for a current frame Gn of the first image data RGB_IMG. Here, the current frame Gn is the same as the non-compensated current frame RGB_IMGn except that it is subjected to a compensation operation carried out by the compensation unit 330. The operation of the output unit 370 will be described in detail further below with reference to FIG. 6.

Referring to FIG. 3, the compensation unit 330 includes an input controller 331, a LUT unit 333, and a compensation calculator 335. The input controller 331 determines whether to receive the non-compensated current frame $RGB_IMG_n$ of the first image data RGB_IMG in response to the first input control signal IN1_CTRL.

The compensation unit 330 compensates for the first image data RGB_IMG, which is moving image data, in the first mode. Accordingly, the input controller 331 controls the non-compensated current frame $RGB_IMG_n$ to be input to the compensation unit 330 in the first mode while preventing the non-compensated current frame $RGB_IMG_n$ from being input to the compensation unit 330 in the second through fourth modes.

The LUT unit 333 stores a predetermined LUT. The LUT unit 333 searches the predetermined LUT for a compensation value DELTA by which a current frame Gn received by the input controller 331 is to be compensated for, in response to the current frame Gn and a previous frame Gn−1 transmitted by the storage unit 310.

Figure 4:
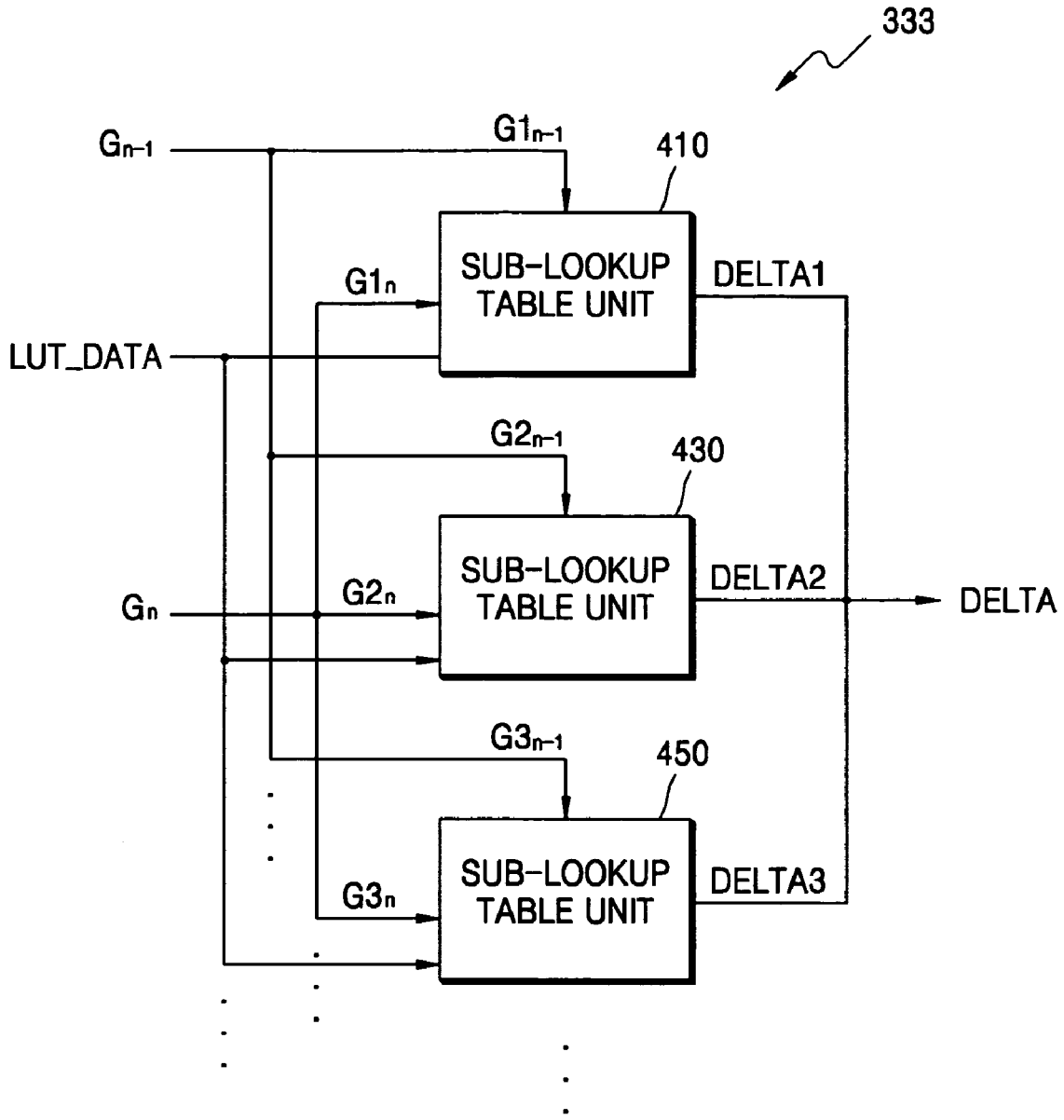
FIG. 4 is a detailed block diagram of a lookup table (LUT) unit for the exemplary apparatus of FIG. 3.

The structure and operation of the LUT unit 333 will now be described in detail with reference to FIG. 4. FIG. 4 is a detailed block diagram of the LUT unit 333 of FIG. 3. Referring to FIG. 4, the LUT unit 333 includes a plurality of sub-LUT units 410, 430, and 450. The sub-LUT units 410, 430, and 450 include a plurality of LUTs for a plurality of frames constituting the first image data RGB_IMG, including the previous and current frames Gn and Gn−1.

The previous frame Gn is comprised of a plurality of pixels, i.e., G1*n*−1, G2*n*−1, and G3*n*−1, and the current frame Gn is comprised of a plurality of pixels, i.e., G1*n*, G2*n*, G3*n*. Each of the pixels G1*n*−1, G2*n*−1, G3*n*−1, G1*n*, G2*n*, and G3*n* may be red (R), green (G), or blue (B) data or gray data of the first image data RGB_IMG.

The sub-lookup table units 410, 430, and 450 search their respective sub-lookup tables for compensation values DELTA1, DELTA2, and DELTA3 by which the pixels $G1_n$, $G2_n$, and $G3_n$, respectively, of the current frame are to be compensated for, and then output the compensation values DELTA1, DELTA2, and DELTA3.

Figure 7:
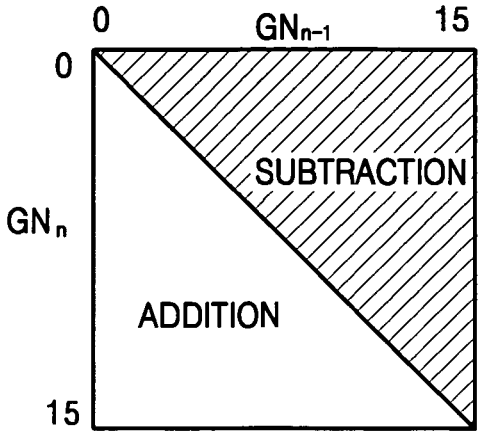
FIG. 7 is a diagram illustrating the structure of an LUT used in the present disclosure.

A process of searching for the compensation values DELTA1, DELTA2, and DELTA3 will now be described in detail with reference to FIG. 7, which is taken out of sequence. FIG. 7 is a diagram illustrating the structure of an LUT used in the present disclosure. Each pixel data of the first image data RGB_IMG is comprised of 6 bits. The higher the quality of a moving image, the larger the size in bits of each pixel data of the moving image. In the present embodiment, four most significant bits (MSBs) of each pixel data are used. Thus, the first image data RGB_IMG can be compensated for regardless of the size in bits of each pixel data thereof.

Referring to FIG. 7, an LUT is stored as a 16×16 matrix. The LUT stores compensation values corresponding to the four MSBs of pixel data $GN_{n-1}$ of the previous frame $G_{n-1}$ of the first image data RGB_IMG therein in a horizontal direction and stores compensation values corresponding to the four MSBs of pixel data $GN_n$ of the current frame $G_n$ of the first image data RGB_IMG therein in a vertical direction. The LUT stores a total of 256 compensation values.

Here, each of the compensation values is an overshoot value, which can be added to or subtracted from the pixel data $GN_n$ of the first image data RGB_IMG. In the RTS method, if the level of pixel data increases, an overshoot value should be added to the level of the pixel data in order to appropriately arrange liquid crystal molecules without time delay. On the other hand, if the level of the pixel data decreases, the overshoot value should be subtracted from the pixel data in order to appropriately arrange the liquid crystal molecules without time delay.

Accordingly, if the level of the pixel data $GN_{n-1}$ is higher than the level of the pixel data $GN_n$, a predetermined overshoot value is added to the pixel data $GN_n$. If the level of the pixel data $GN_{n-1}$ is lower than the level of the pixel data $GN_n$, the predetermined overshoot value is added to the pixel data $GN_n$. If the level of the pixel data $GN_{n-1}$ is the same as the level of the pixel data $GN_n$, the predetermined overshoot value does not need to be added to or subtracted from the pixel data $GN_n$. The predetermined overshoot value is determined according to the characteristics of an LCD device.

The characteristics of the LCD device may vary in accordance with variations in the surroundings, such as variations in temperature and the electrical characteristics of circuits adjacent to the LCD device. Accordingly, overshoot values stored in the LUT may be updated according to the variation of the characteristics of the LCD device.

As described above, the overshoot values can be updated based on CPU data. In other words, when the LCD device starts operating, the CPU data containing LUT data appropriate for the LCD device is transmitted to the LCD driving apparatus 300 of FIG. 3, and then the LUT is initialized based on the LUT data.

In addition, the LUT may be updated or adjusted based on LUT data to be adjusted according to the variation of the characteristics of the LCD device that is contained in the CPU data transmitted to the LCD driving apparatus 300 of FIG. 3. Accordingly, a memory that is readable and writable may be used as the LUT. In the present embodiment, a register is used as the LUT, so the LUT can be easily initialized, updated, or adjusted.

Referring to FIG. 4, the sub-LUT units 410, 430, and 450 operate in parallel. Parallel operation considerably reduces the amount of time required for searching for the compensation values DELTA1, DELTA2, and DELTA3.

Referring to FIG. 3, the compensation calculator 335 compensates for the current frame Gn of the first image data RGB_IMG by the compensation value DELTA based on a result of comparing the current frame Gn with the previous frame $G_{n-1}$ of the first image data RGB_IMG. The structure and operation of the compensation calculator 335 will now be described in detail with reference to FIG. 5.

Figure 5:
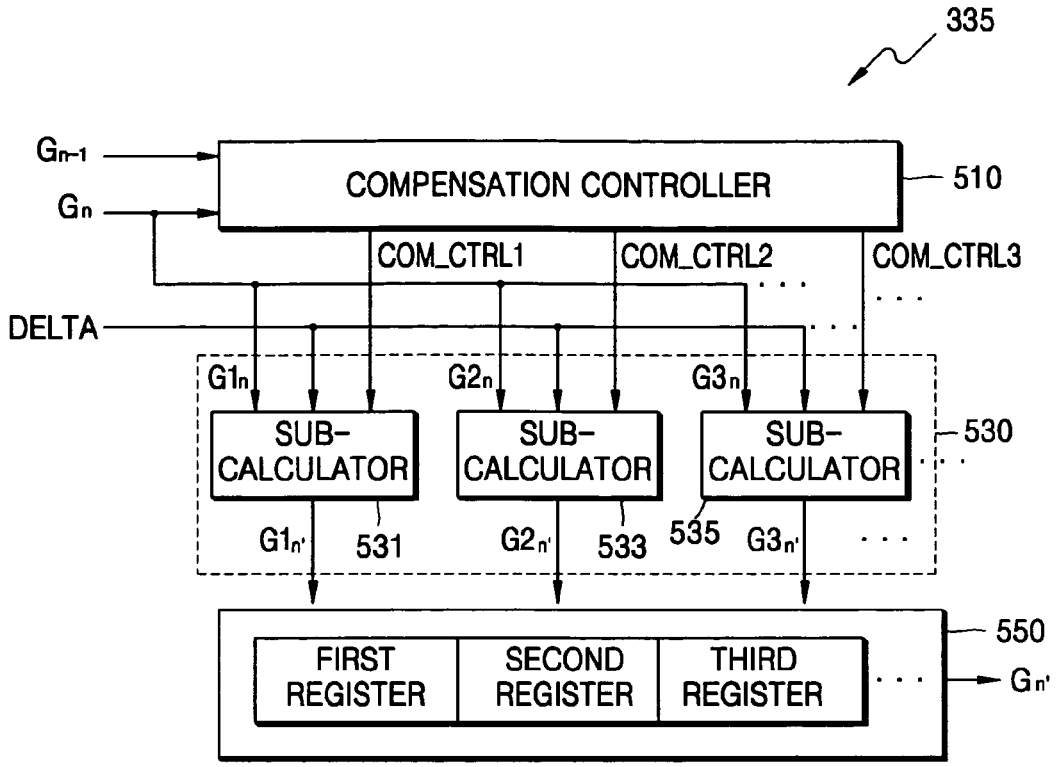
FIG. 5 is a detailed block diagram of a compensation calculator for the exemplary apparatus of FIG. 3.

FIG. 5 is a detailed block diagram of the compensation calculator 335 of FIG. 3. Referring to FIG. 5, the compensation calculator 335 includes a compensation controller 510, a calculator 530, and a compensation image storage 550. The calculator 530 performs a predetermined operation on the current frame $G_n$ and the compensation value in response to a compensation control signal COM_CTRL.

The calculator 530 includes a plurality of sub-calculators, i.e., 531, 533, and 535. The sub-calculators 531, 533, and 535 perform a predetermined operation on the pixel data $G1_n$, $G2_n$, and $G3_n$, respectively, of the current frame $G_n$ and the compensation values DELTA1, DELTA2, and DELTA3, respectively, in response to compensation control signals COM_CTRL1, COM_CTRL2, and COM_CTRL3, respectively.

In the present embodiment, the sub-calculators 531, 533, and 535 operate in parallel, thus reducing the amount of time required for generating the compensated current frame $G_n'$. The compensation controller 510 generates the compensation control signals COM_CTRL1, COM_CTRL2, and COM_C-

TRL3 in response to the pixel data $G1_n$, $G2_n$, and $G3_n$ of the current frame $G_n$ and the pixel data $G1_{n-1}$, $G2_{n-1}$, and $G3_{n-1}$ of the previous frame $G_{n-1}$.

In response to the compensation control signals COM_CTRL1, COM_CTRL2, and COM_CTRL3, the compensation values DELTA1, DELTA2, and DELTA3 may be added to or subtracted from the pixel data $G1_n$, $G2_n$, and $G3_n$, respectively, of the current frame $G_n$. Specifically, if the levels of the pixel data $G1_n$, $G2_n$, and $G3_n$ of the current frame $G_n$ are higher than the levels of the respective pixel data $G1_{n-1}$, $G2_{n-1}$, and $G3_{n-1}$ of the previous frame $G_{n-1}$, the compensation values DELTA1, DELTA2, and DELTA3 are added to the pixel data $G1_n$, $G2_n$, and $G3_n$, respectively, of the current frame $G_n$ in response to the compensation control signals COM_CTRL1, COM_CTRL2, and COM_CTRL3, respectively. However, if the levels of the pixel data $G1_n$, $G2_n$, and $G3_n$ of the current frame $G_n$ are lower than the levels of the respective pixel data $G1_{n-1}$, $G2_{n-1}$, and $G3_{n-1}$ of the previous frame $G_{n-1}$, the compensation values DELTA1, DELTA2, and DELTA3 are subtracted from the pixel data $G1_n$, $G2_n$, and $G3_n$, respectively, of the current frame $G_n$ in response to the compensation control signals COM_CTRL1, COM_CTRL2, and COM_CTRL3, respectively.

The compensated image storage 550 includes a plurality of registers which store compensated pixel data $G1_n'$, $G2_n'$, and $G3_n'$ of the current frame $G_n$ obtained by the sub-calculators 531, 533, and 535, respectively. The compensated image storage 550 outputs the compensated pixel data $G1_n'$, $G2_n'$, and $G3_n'$ of the current frame $G_n$ in series.

Figure 6:
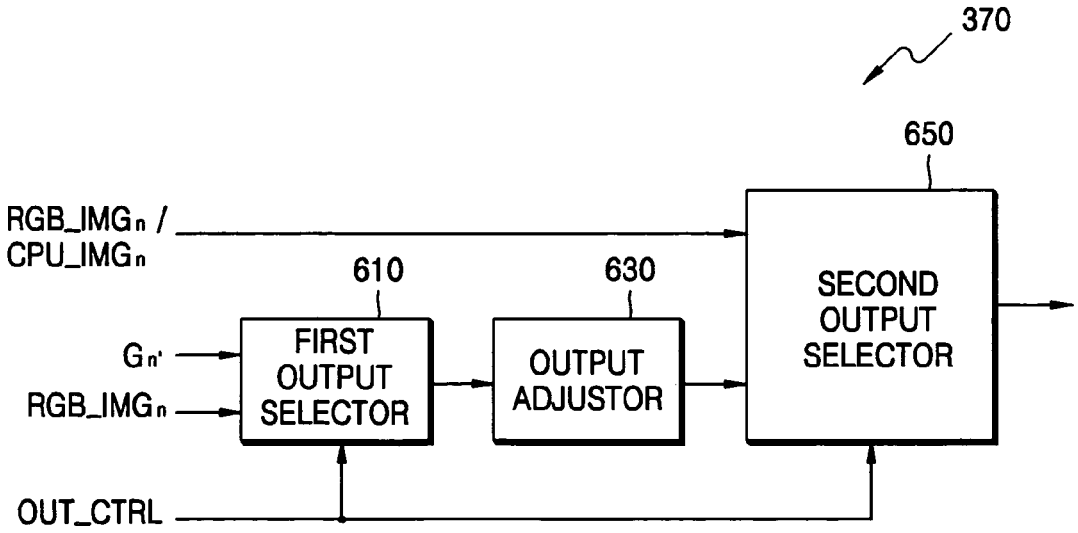
FIG. 6 is a detailed block diagram of an output unit for the exemplary apparatus of FIG. 3.

FIG. 6 is a detailed block diagram of the output unit 370 of FIG. 3. Referring to FIG. 6, the output unit 370 includes a first output selector 610, an output adjustor 630, and a second output selector 650. The first output selector 610 selects one of the non-compensated current frame $RGB_IMG_n$ of the first image data RGB_IMG and the compensated current frame $G_n'$ of the first image data RGB_IMG and then outputs the selected frame.

In the present embodiment, the first mode is a moving image compensation mode in which an LCD device is driven to display a high-quality moving image. Accordingly, in the first mode, the first image data RGB_IMG is compensated for with reference to a predetermined LUT, and then the LCD device is driven based on the compensation results.

On the other hand, the fourth mode is a bypass mode in which the LCD device is driven to display a regular moving image with a short update cycle. Therefore, in the fourth mode, unlike in the first mode, the first image data RGB_IMG is not compensated for, and the LCD device is driven based on the first image data RGB_IMG.

Accordingly, in the first mode, the first output selector 610 selects and outputs the compensated current frame $G_n'$ of the first image data RGB_IMG. On the other hand, in the fourth mode, the first output selector 610 selects and outputs the non-compensated current frame $RGB_IMG_n$ of the first image data RGB_IMG.

The second mode is a regular moving image mode in which the LCD device is driven to display a regular moving image with a long update cycle, and the third mode is a still image mode in which the LCD device is driven to display a still image. In the second or third mode, the first image data RGB_IMG or the second image data CPU_IMG, respectively, is stored in the storage unit 310 and is output to the output unit 370 in response to the second input control signal IN2_CTRL.

In order to synchronize the output of the storage unit 310 with the output of the first output selector 610 to the second output selector 650 in the second or third mode, the first output selector 610 must delay the outputting of the compensated or non-compensated current frame $G_n$ or $RGB_IMG_n$ to the second output selector 650 by the amount of time required for storing and then outputting the first or second image data RGB_IMG or CPU_IMG. Accordingly, the output adjustor 630 delays the inputting of the output of the first output selector 610 to the second output selector 650 by a predetermined amount of time. The output adjustor 630 may be a latch circuit.

The second output selector 650 selects one of the output of the output adjustor 630 and the output of the storage unit 310 and then outputs the selected output signal in response to the output control signal OUT_CTRL. Specifically, the second output selector 650 selects and outputs the output of the output adjustor 630 in the first or fourth mode and selects and outputs the output of the storage unit 310 in the second or third mode.

Figure 8:
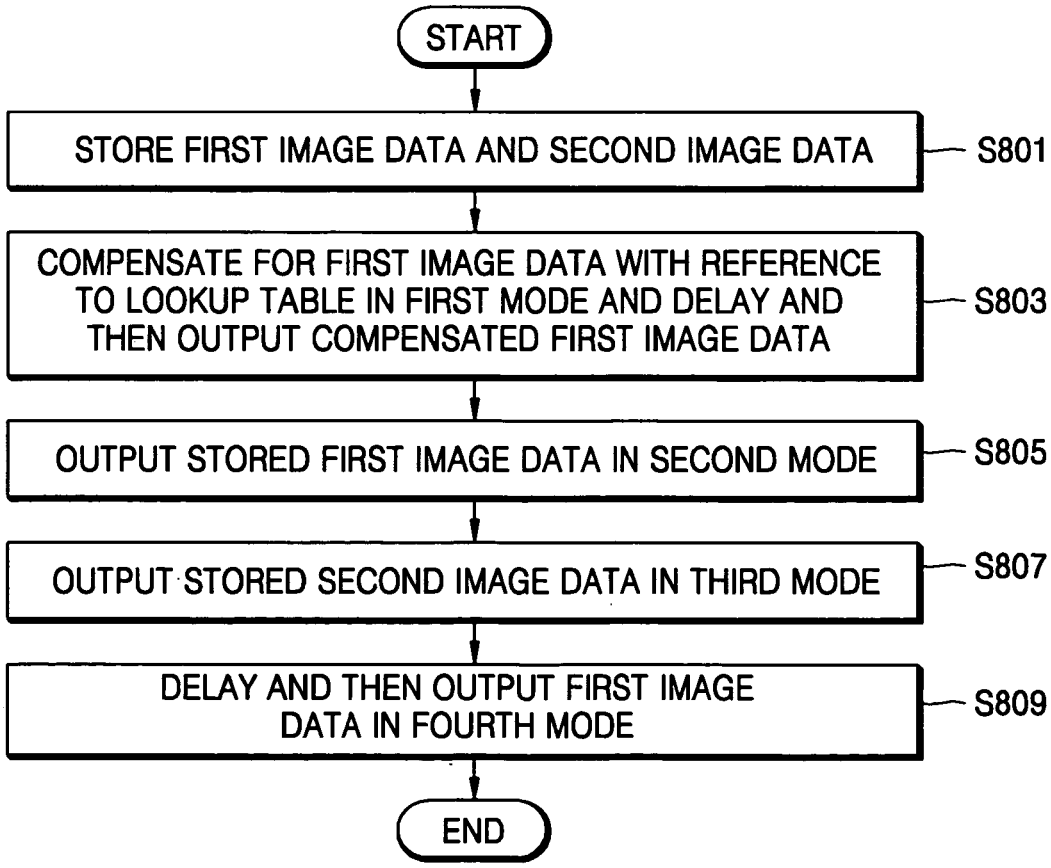
FIG. 8 is a flowchart of an LCD driving method according to an exemplary embodiment of the present disclosure.

FIG. 8 is a flowchart of an LCD driving method according to an exemplary embodiment of the present disclosure. Referring to FIG. 8, in operation S801, first image data and second image data output from a CPU or a baseband processing unit are stored in order to drive an LCD panel of an LCD device.

The LCD panel is driven in one of a total of four modes, i.e., first through fourth modes, as described above. In the first mode, the LCD panel is driven to display a high-quality moving image. In operation S803, in the first mode, the first image data is compensated for with reference to a predetermined LUT based on a result of comparing the current frame with a previous frame, and the compensated first image data is output after being delayed for a predetermined amount of time.

In the second mode, the LCD panel is driven to display a regular moving image with a long update cycle. In operation S805, in the second mode, the first image data is directly output.

In the third mode, the LCD panel is driven to display a still image. In operation S807, in the third mode, the second image data is output.

In the fourth mode, the LCD panel is driven to display a regular moving image with a short update cycle. In operation S809, the first image data is output after being delayed for a predetermined amount of time. As described above, the LCD driving apparatus and method according to the present disclosure can reduce the amount of energy consumed in driving an LCD device. In addition, the LCD driving apparatus and method according to the present disclosure can display a high-quality moving image on a small-sized LCD panel without distortion, such as tailing or blurriness. Moreover, the LCD driving apparatus and method according to the present disclosure can reduce the power consumption, size, and manufacturing cost of an LCD device.

While the present invention has been particularly shown and described with reference to exemplary embodiments thereof, it will be understood by those of ordinary skill in the pertinent art that various changes in form and details may be made therein without departing from the spirit and scope of the present invention as defined by the following claims.

What is claimed is:

1. An apparatus for driving a liquid crystal display (LCD) panel of an LCD device, the apparatus comprising:

a compensation unit, which compensates for first image data with reference to a predetermined lookup table (LUT), which includes a plurality of sub-LUTs for a plurality of pixel data of the first image data, in response to a first input control signal in a first mode, the first image data being consecutively input to the apparatus, the compensation unit having a LUT unit, which stores the predetermined LUT, searches the predetermined LUT for a compensation value, by which the current frame of the first image data is to be compensated for, with reference to the current frame and a frame of the first image data previously input to the apparatus, and outputs the searched compensation value, the frame being referred to as a previous frame, and the LUT unit having a plurality of sub-LUT units, which store the plurality of sub-LUTs for the plurality of pixel data of the first image data, search the sub-LUTs for compensation values for the pixel data of the first image data with reference to pixel data of the current frame of the first image data and pixel data of the previous frame of the first image data, and output the searched compensation values;

a storage unit, which updates and then stores the first image data and second image data and outputs one of the first image data or the second image data in response to a second input control signal, the second image data being consecutively input to the apparatus;

an output unit, which outputs one of the first image data, the second image data, or the compensated first image data in response to an output control signal; and a control unit, which generates the first input control signal, the second input control signal, and the output control signal in response to a predetermined control signal.

2. The apparatus of claim 1, wherein the storage unit outputs the first image data stored therein to the output unit in a second mode and outputs the second image data stored therein to the output unit in a third mode.

3. The apparatus of claim 1, wherein the compensation unit comprises:

an input controller, which determines whether to receive a frame of the first image data currently being input to the apparatus in response to the first input control signal, the frame being referred to as a current frame; and a compensation calculator, which generates the compensated first image data based on the current frame, the previous frame, and the compensation value.

4. The apparatus of claim 3, wherein the input controller controls the first image data to be input to the compensation unit in the first mode and prevents the first image data from being input to the compensation unit in any of the second and third modes and a fourth mode.

5. The apparatus of claim 3, wherein the sub-LUT units operate in parallel.

6. The apparatus of claim 3, wherein the LUT unit updates the predetermined LUT based on predetermined LUT data.

7. The apparatus of claim 3, wherein the LUT is a register.

8. The apparatus of claim 3, wherein the compensation value is an overshoot value for the current frame of the first image data.

9. The apparatus of claim 3, wherein the output unit comprises:

a first output selector, which outputs one of the current frame of the first image data and the compensated current frame of the first image data in response to the output control signal;

an output adjustor, which delays the output of the first output selector for a predetermined amount of time; and a second output selector, which outputs one of the output of the first output selector or the output of the storage unit in response to the output control signal.

10. The apparatus of claim 9, wherein the first output selector selects and then outputs the compensated first image data in the first mode and selects and then outputs the non-compensated first image data in the fourth mode.

11. The apparatus of claim 9, wherein the output adjustor is a latch.

12. The apparatus of claim 9, wherein the second output selector selects and then outputs the output of the output adjustor in one of the first or fourth modes and selects and then outputs the output of the storage unit in one of the second or third modes.

13. The apparatus of claim 1, wherein the first image data is moving image data, and the second image data is still image data.

14. The apparatus of claim 1, wherein the first mode is a moving image compensation mode, the second mode is a regular moving image mode, the third mode is a still image mode, and the fourth mode is a bypass mode.

15. An apparatus for driving a liquid crystal display (LCD) panel of an LCD device, the apparatus comprising:

a compensation unit, which compensates for first image data with reference to a predetermined lookup table (LUT), which includes a plurality of sub-LUTs for a plurality of pixel data of the first image data, in response to a first input control signal in a first mode, the first image data being consecutively input to the apparatus;

a storage unit, which updates and then stores the first image data and second image data and outputs one of the first image data or the second image data in response to a second input control signal, the second image data being consecutively input to the apparatus;

an output unit, which outputs one of the first image data, the second image data, or the compensated first image data in response to an output control signal; and a control unit, which generates the first input control signal, the second input control signal, and the output control signal in response to a predetermined control signal, wherein the compensation unit comprises:

and input controller, which determines whether to receive a frame of the first image data currently being input to the apparatus in response to the first input control signal, the frame being referred to as a current frame;

a LUT unit, which stores the predetermined LUT, searches the predetermined LUT for a compensation value, by which the current frame of the first image data is to be compensated for, with reference to the current frame and a frame of the first image data previously input to the apparatus, and outputs the searched compensation value, the frame being referred to as a previous frame; and a compensation calculator, which generates the compensated first image data based on the current frame, the previous frame, and the compensation value, wherein the compensation calculator comprises:

a calculator, which performs a predetermined operation on the current frame of the first image data and the compensation value in response to a compensation control signal; and a compensation controller, which generates the compensation control signal based on the current frame and the previous frame of the first image data, wherein the calculator comprises a plurality of sub-calculators, which compensate for the pixel data of the current frame of the first image data by performing a predetermined operation on the pixel data of the current frame of the first image data with the respective compensation value.

16. The apparatus of claim 15, wherein the calculator adds the compensation value to the current frame of the first image data in response to the compensation control signal if the level of the current frame of the first image data is higher than the level of the previous frame of the first image data, subtracts the compensation value from the current frame of the first image data if the level of the current frame of the first image data is lower than the level of the previous frame of the first image data, and maintains the current frame of the first image data if the level of the current frame of the first image data is the same as the level of the previous frame of the first image data.

17. The apparatus of claim 15, wherein the sub-calculators operate in parallel.

18. The apparatus of claim 15, wherein the compensation calculator further comprises a compensation image storage, which comprises a plurality of registers that stores compensated pixel data of the current frame of the first image data obtained by the sub-calculators, wherein the compensated image storage outputs the compensated pixel data of the current frames of the first image data in series.

19. A method of driving a liquid crystal display (LCD) panel of a LCD device, the method comprising:

storing a predetermined lookup table (LUT);

storing first image data and second image data, which are consecutively input;

searching the predetermined LUT for a LUT compensation value, by which a current frame of the first image data is to be compensated with reference to the current frame and a previous frame of the first image data previously input to the apparatus;

outputting the searched LUT compensation value;

compensating for the first image data with reference to LUT, which includes a plurality of sub-LUTs for a plurality of pixel data of the first image data, based on a result of comparing the current frame of the first image data with a previous frame of the first image data and delaying and then outputting the compensated first image data in a first mode;

storing the plurality of sub-LUTs for the plurality of pixel data of the first image data;

searching the sub-LUTs for sub-LUT compensation values for the pixel data of the first image data with reference to pixel data of the current frame of the first image data and pixel data of the previous frame of the first image data;

outputting the searched sub-LUT compensation values;

outputting the stored first image data in a second mode;

outputting the stored second image data in a third mode; and delaying and then outputting the first image data in a fourth mode.

20. The method of claim 19, wherein the compensating of the first image data comprises:

searching the predetermined LUT for a compensation value, by which the first image data is to be compensated for, with reference to the current and previous frames of the first image data; and performing a predetermined operation on the compensation value and the current frame of the first image data based on the result of comparing the current frame and the previous frame of the first image data.

21. The method of claim 20, wherein the performing of the predetermined operation on the compensation value and the current frame of the first image data comprises:

adding the compensation value to the first image data if the level of the current frame of the first image data is higher than the level of the previous frame of the first image data;

subtracting the compensation value from the first image data if the level of the current frame of the first image data is lower than the level of the previous frame of the first image data; and maintaining the first image data if the level of the current frame of the first image data is the same as the level of the previous frame of the first image data.

22. The method of claim 19, wherein the first image data is moving image data, and the second image data is still image data.

23. The method of claim 19, wherein the first mode is a moving image compensation mode, the second mode is a regular moving image mode, the third mode is a still image mode, and the fourth mode is a bypass mode.

* * * * *